United States Patent [19]

Bolan et al.

[11] 3,973,775

[45] Aug. 10, 1976

[54] GAME BOARD APPARATUS

[76] Inventors: William Bernard Bolan, 846 W. Centerville Road; Steve Wayne Hodges, 937 Patio Court, both of Garland, Tex. 75041

[22] Filed: Oct. 2, 1974

[21] Appl. No.: 511,225

[52] U.S. Cl. ..... 273/134 AA; 273/134 A; 273/134 G

[51] Int. Cl.[2] ..... A63F 3/00

[58] Field of Search ..... 273/134

[56] References Cited

UNITED STATES PATENTS

| | | | |
|---|---|---|---|
| 2,177,078 | 10/1939 | Raizen et al. | 273/134 C |
| 2,239,779 | 4/1941 | Clark et al. | 273/134 AD |
| 3,556,528 | 1/1971 | Spiring | 273/134 AC |
| 3,674,273 | 7/1972 | Sells | 273/134 AA |
| 3,740,037 | 6/1973 | De Bono | 273/134 AF |

*Primary Examiner*—Delbert B. Lowe

*Attorney, Agent, or Firm*—Hubbard, Thurman, Turner & Tucker

[57] ABSTRACT

A game apparatus is disclosed which includes an inner game board with a plurality of territorial representations thereon and a grid system dividing the surface into a plurality of grid segments, and an outer game board having a plurality of playing positions around the periphery of the game board. The apparatus also includes a plurality of player markers for movement around the periphery of the outer game board in accordance with preselected game rules. A plurality of player tokens are provided for movement within the grid segments of the inner game board in accordance with a preselected set of game rules. A plurality of instruction cards are provided to instruct players to take certain actions in accordance with the preselected game rules. Movement of the player markers and the player tokens is primarily controlled by the roll of a die. A random signal generating device is provided whereby random signal designations can be generated in response to the action of two different players and the random signal can be decoded to provide instructions to the players to take certain actions within the grid segments of the inner board. Players seek to occupy and capture the territories represented on the inner board to use them as bases for a strategic warlike portion of the game in which the players seek to destroy the opponents' territories and the player tokens thereon. The game is ended when only one player still possesses player tokens within the grid segments of the inner board.

9 Claims, 9 Drawing Figures

GAME BOARD APPARATUS

This invention relates to a game board apparatus. In another aspect, this invention relates to an improved game board apparatus utilizing an inner game board and an outer game board. In still another aspect, this invention relates to a game board apparatus utilizing an inner game board and an outer game board having territorial representations on the inner game board with the game being based on a concept of occupation of planets and interplanetary warfare.

In recent years, the popularity of games has increased dramatically. A tremendous number of new games are constantly being offered to the buying public. Only a very few of the new games being offered for sale ever achieve any degree of popularity. Of those few games that do achieve some degree of popularity, still fewer maintain their popularity for any significant time.

Several reasons have been given for the lack of acceptance and continued popularity of games. One reason that games do not remain popular is the fact that they are fad-type games that do not involve any particular skill or imagination to play. Another reason that games do not retain their popularity is the fact that there is no challenge in the playing of the game to promote a continued interest in the game. Still another reason why games do not retain their popularity is the fact that most games are directed to a very narrow age group and therefore cannot be enjoyed by a wide segment of our population.

It is, therefore, an object of the present invention to provide a new game apparatus. It is another object of this invention to provide a new game apparatus that can be played and enjoyed by a wide age group. It is still another object of this invention to provide an improved game apparatus that is educational and develops a high degree of skill in playing. It is still a further object of this invention to provide an improved game apparatus that will assist in the development of a high level of logic and judgment by players without creating boredom.

Other aspects, objects and advantages of this invention will be apparent to those skilled in the art upon examining the following disclosure.

The present invention is directed to an improved game apparatus. The game apparatus includes an inner game board and an outer game board. The inner game board is divided into a grid by means of various grid lines to define grid segments. The inner game board also has a plurality of spaced apart territorial designations across the surface of the inner game board. The outer game board includes a plurality of player positions around the periphery of the outer game board with various instruction indicia within the playing positions. Players are provided with player markers that can be moved around the periphery of the outer game board in accordance with preselected game rules. A plurality of player tokens are also provided for placement and movement within the grid segments of the inner game board in accordance with the preselected game rules. A plurality of instruction cards, having instruction indicia on one side thereof, are provided to instruct players to take certain actions in accordance with the preselected game rules. The instruction cards are combined in a deck with the instruction indicia face down so the players may draw the individual cards at selected times to receive instructions. The early stages of the game include the movement of the player markers around the periphery of the outer game board until such time as the players are instructed to place certain of their player tokens in one of the designated territorial indicia on the inner game board. This procedure is followed by all players, who attempt to place as many of their player tokens on the inner board as possible. The game proceeds by the players then attempting to lay claim to and capture the other territorial bodies depicted on the surface of the inner game board. Movements of the player markers around the periphery of the game board and the player tokens within the grid segments of the inner game board are primarily directed by chance means such as by rolling dice and moving the markers or tokens in accordance with the roll of the dice. Once all of the territorial bodies are captured, the final stages of the game are played by a series of tactical engagements wherein each player tries to destroy the territory and the tokens of the other players. Players are eliminated from the game as they lose all of their player tokens. The winner of the game is the last surviving player having player tokens on the inner game board. The tactical portion of the game is carried out using a random signal generator wherein two players provide an input to the random signal generator to produce the random signal, which is thereafter decoded, using a suitable table or decoding means, to specify the action or result of each tactical maneuver.

The game apparatus of this invention can best be described by referring to the drawings which include the following:

The following description of the game and game apparatus of this invention is directed to one of the preferred embodiments of the invention wherein a game based on interplanetary exploration, occupation and warfare is disclosed.

The apparatus illustrated in FIGS. 1 through 9 is particularly applicable to a game wherein the individual players capture territories on the inner game board, in accordance with preselected rules, and thereafter battle each other to destroy the opponents' territories and missiles or space ships. The ultimate object of the game is to be the last player with missiles or space ships remaining on the surface of the inner game board. In the following description, it will be apparent that many variations of the basic set of rules can be made. However, for the sake of explanation, one preferred set of rules will be discussed for use in the playing of the game utilizing the claimed game apparatus.

Figure 1:
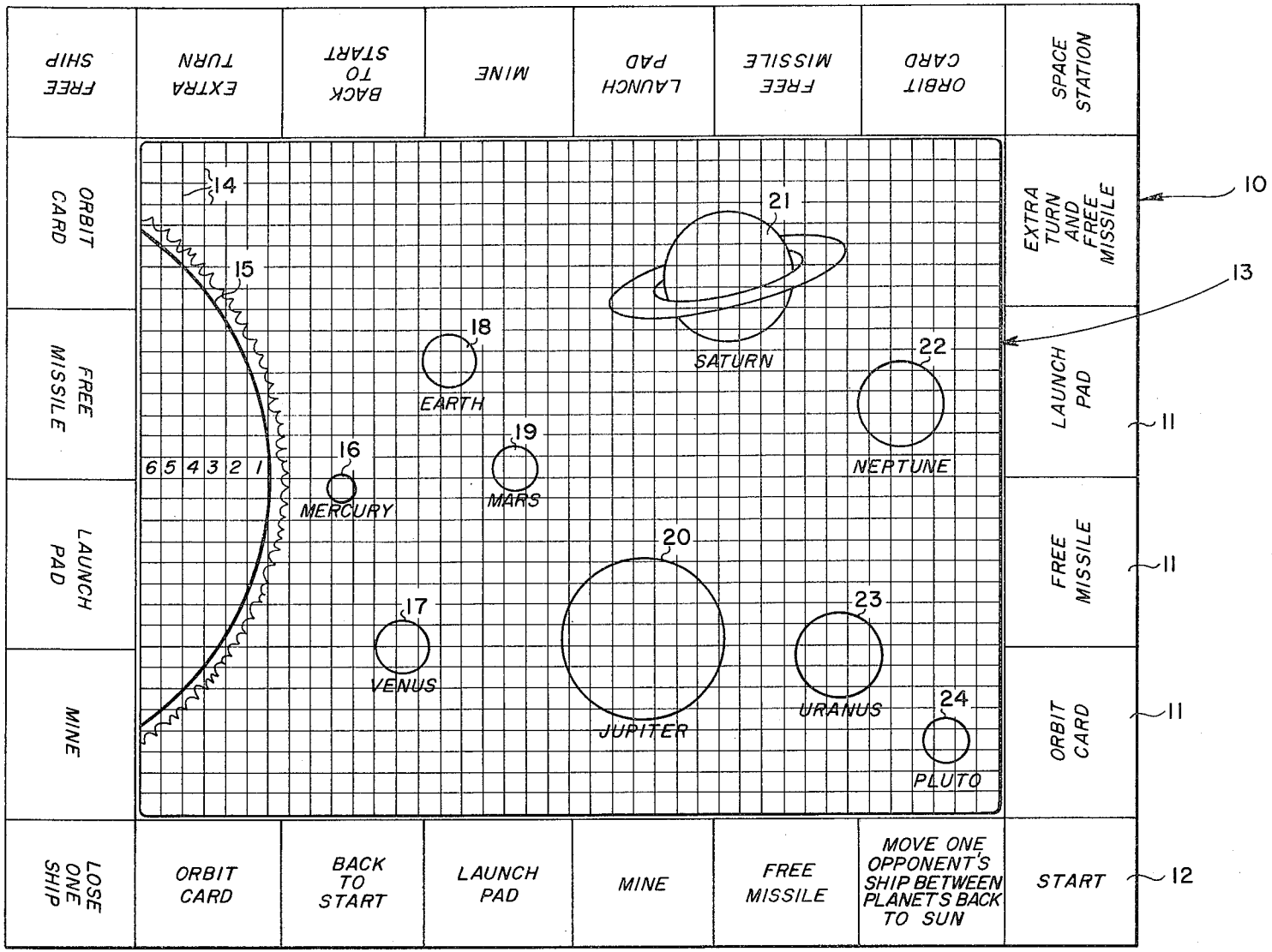
FIG. 1 is a top view of the inner playing board and the outer playing board, showing one preferred configuration of each.

FIG. 1 illustrates outer game board 10. The periphery of outer game board 10 is divided into a plurality of player positions 11 to accommodate player marker means, as hereinafter described. One of the playing positions on the periphery of outer game board 10 will be designated as "start" 12. From this position, all participating players will start movement in the game. Indicia will be placed within each of the remaining playing positions to convey instructions to players or to provide a neutral territory.

Any desired number of player positions can be disposed around the periphery of outer game board 10. However, in playing the game with conventional cube shaped dice, it is preferred that the individual player positions not exceed ten along each side of a square or rectangular outer playing board.

Inner game board 13 is usually disposed within the borders of outer game board 10, with the periphery of outer game board 10 and the various playing positions 11 disposed around the perimeter of inner game board 13. The surface of inner game board 13 is divided into a series of grid segments that will accommodate player token means, as hereinafter described, by means of a series of grid lines 14. The number of grid lines 14 appearing on the surface of inner game board 13 is a matter of choice. It is preferred, however, that the number of grid lines on the surface of inner game board 13 be sufficiently great to allow for the strategic movement of player tokens across the surface thereof to occupy and capture various territorial bodies thereon. When using conventional cube shaped dice to direct movement of the player tokens on the surface of inner game board 13, it is preferred that the number of grid lines be at least 20 in each direction so that at least 400 grid segments are present on the surface of inner game board 13.

At least three territorial indicia are placed on the surface of inner game board 13. One of the territorial indicia, usually the largest, is preferably spaced toward one side of inner game board 13 and serves as neutral territory, which is not subject to capture by any of the players. In the preferred embodiment of our invention illustrated in the drawings, the sun is designated as neutral territory 15. Grid lines 14 are superimposed on the sun such as to form at least six separate rows of grid segments on the surface of sun 15. These lines of grid segments are numbered 1 through 6 and serve as player rows, as will be described in more detail hereinafter.

In addition to the indicia indicating sun 15 on the surface of inner game board 13, various other indicia are present to depict planetary bodies that will be utilized in the playing of the game. The planetary bodies are spaced apart from each other and are located at various points across the surface of inner game board 13. As indicated in FIG. 1 indicia are present to mark the location of Mercury 16, Venus 17, Earth 18, Mars 19, Jupiter 20, Saturn 21, Neptune 22, Uranus 23, and Pluto 24. It is, of course, understood that other bodies can be indicated by suitable indicia upon the surface of inner game board 13. It should also be noted that grid lines 14 divide the surface of the planetary indicia into grid segments.

While outer game board 10 and inner game board 13 have been illustrated as being rectangular in shape, it should be realized that the game boards can be of any desired shape. For example, the game boards can be circular if so desired. In some instances it may be desirable to fabricate the game boards of cardboard or other heavy materials so they may be folded into small segments for easy storage. The game boards can also be fabricated of other suitable materials such as plastic, wood, particle board and the like. In one preferred embodiment, inner game board 13 will be disposed in a plane substantially parallel to but above the plane of outer game board 10. This vertical displacement of the surfaces of the two game boards lends reality to the game wherein player tokens "move up into space."

Figure 2:
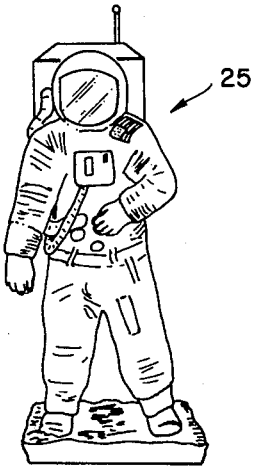
FIG. 2 is a perspective view of one preferred player marker.

FIG. 2 illustrates one of the preferred player markers that is utilized for movement around the periphery of outer game board 10. Player marker 25 can be any suitable article that can be identified with an individual player. Therefore, the individual player markers should have either distinctive shapes or colors or other suitable indicia for identifying a separate player marker with each separate player in the game. The illustrated player marker 25 represents an astronaut or suitable space explorer. Player markers can be fabricated from any suitable material but it has been found especially desirable to fabricate them from plastic material that can be easily cast and molded. In such instances it is desirable to have player markers of differing colors. It is desirable to have at least three separate player markers for each participant in the game. Player markers 25 should be of such size as to allow several of them to rest within one playing position 11 of outer game board 10.

Figure 3:
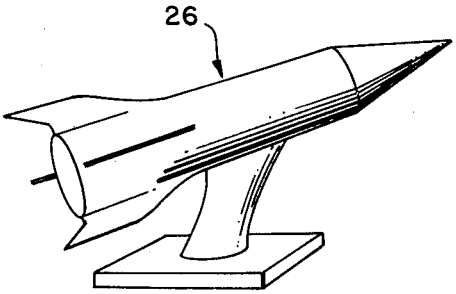
FIG. 3 is a perspective view of one preferred player token representing a space ship.

FIG. 3 illustrates one preferred type of player token that is utilized for movement across the surface of inner game board 13. Illustrated player token 26 is a space ship that will be utilized to mark the progress of players in their attempts to occupy and capture different territorial bodies on the surface of inner game board 13. As in the case of player markers 25, player tokens 26 must have some suitable means for identifying them with individual players. Therefore, it is desirable that each set of player tokens 26 be of a distinctive color or shape so that each player participating in the game may have easily identifiable player tokens. Player tokens 26 can be of any suitable material; however, molded plastic player tokens having distinctive color codes are preferred.

Figure 4:
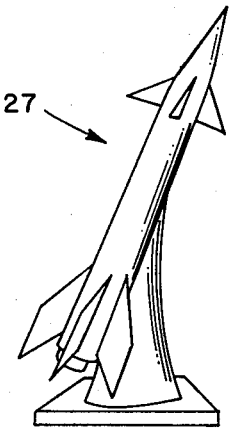
FIG. 4 is a perspective view of one preferred player token representing a missile that can be utilized during the latter phases or during the tactical phase of the game.

FIG. 4 illustrates a second type of player token that can be utilized in the instant game apparatus. Player token 27 represents a space missile that can be utilized during the last phases of the game wherein the individual players undertake a strategic war-like series of maneuvers to destroy the opponents' territories and player tokens. As in the case of player marker 25 and player token 26, player token 27 should be of a distinctive color or shape that can be easily identifiable with the individual player controlling player token 27. Therefore, it is desirable to fabricate player token 27 from a material such as plastic that can be color coded so that each player participating in the game may have a plurality of player tokens 27 bearing a common color or color code.

Player tokens 26 and 27 should be of such size as to allow one such token to rest within a single grid segment of inner game board 13.

It is desirable that each player have at least 12 player tokens 26 and/or 27 for use as the game progresses.

While player marker 25, player token 26 and player token 27 have been depicted as being small articles having a flat base to rest upon the surface of either outer game board 10 or inner game board 13, it will be apparent that other types of support bases can be utilized for the markers or the tokens. For example, small pin-like structures can be placed in the bottom of markers 25 or tokens 26 or tokens 27 so that they may be stuck into the surface of outer game board 10 or inner game board 13. In such instances, it will be desirable that the surface of outer game board 10 and inner game board 13 be fabricated of a suitable porous material that will receive and hold the pin-type supports. Such materials include cork, heavy corrugated cardboard, foamed plastic, particle board and the like.

Figure 5:
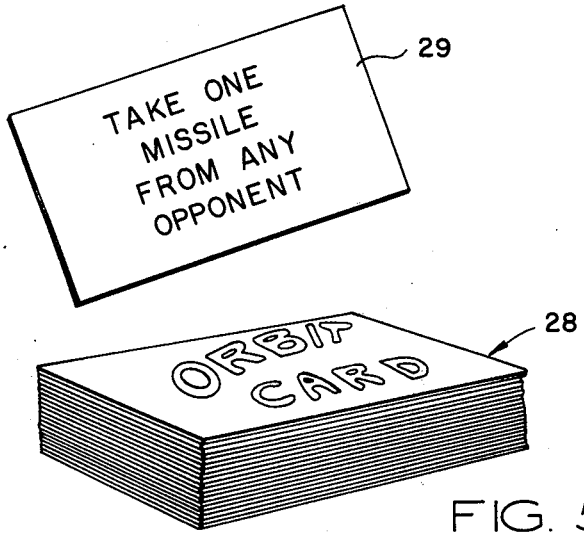
FIG. 5 is a perspective view of a preferred set of instruction cards.

The apparatus of this invention also includes a plurality of instruction cards that are utilized to instruct the players to take various actions with either player markers 25 or player tokens 26 during the course of the game. In one preferred embodiment, these instruction cards can be referred to as "orbit cards." Examples of suitable orbit cards are illustrated in FIG. 5 wherein a stack of orbit cards 28 is illustrated with an individual orbit card 29 disposed abovt it, illustrating one instructional message on the lower surface of the orbit card. Individual orbit cards 29 have instructional messages printed only on one side thereof so that they may be stacked with the message face down during the playing of the game. By utilizing this type of stacking, players are unaware of the next series of instructions that will be issued by the orbit cards as the game progresses. Any number of orbit cards can be utilized in the apparatus of this invention. Preferably, however, from about 25 to 75 separate orbit cards are utilized with many different types of instructional messages printed on the individual orbit cards. The instructional messages printed on the orbit cards can be such messages as:

"You receive one free ship to Venus if unowned;"
"Move ahead three spaces on the board;"
"Go to space station;"
"Take one missile from any opponent;"
"One missile saved from direct hit, opponent must remove one of his missiles;"
"This card cancels out any other orbit card of your opponents;"
"Anti-ballistic card, saves one ship from being hit;"
"Send one of any opponent's ships that may be between planets back to sun;"
"Anti-mine card, eliminates mine or gives one free turn;"
"You receive one free missile;"
"Free ship to the sun;" and the like.

From the foregoing it should be apparent that many different types of messages can be placed on individual orbit cards utilized in the playing of the game.

The apparatus of this game also includes at least one chance means that is utilized by the players to determine the number of spaces to be moved by layer marker 25 or player tokens 26 during the progress of the game. One particularly preferred type of chance means is a common cube shaped die. If desired, each player may have a separate die for use as the game progresses.

The apparatus of this invention also includes a random signal generator that is utilized during the portion of the game wherein the individual players seek to destroy the opponents' player tokens. Any suitable means can be utilized for the random signal generator.

In its simplest form, the random signal generator can be a plurality of numbered tokens or chips that can be drawn by the individual players.

Figure 6:
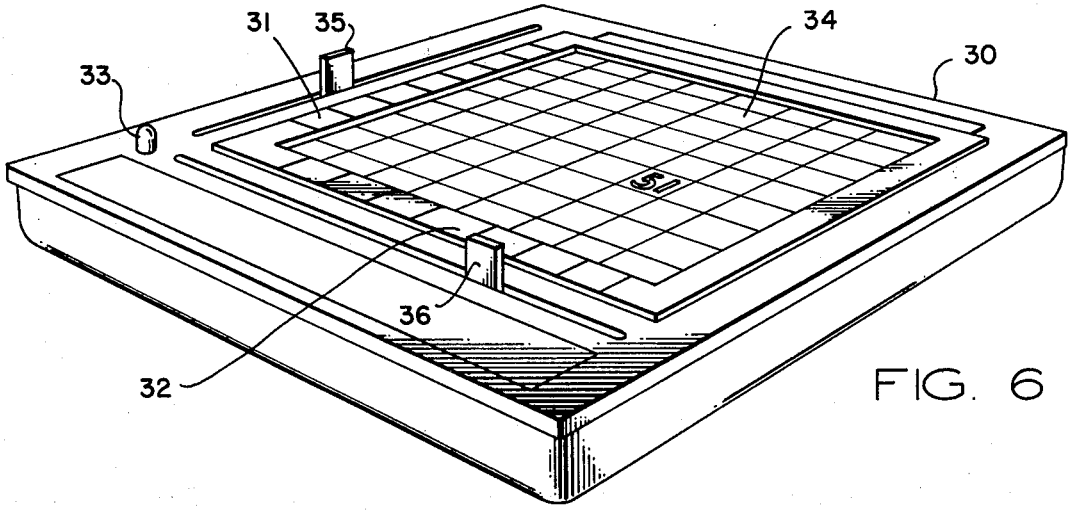
FIG. 6 is a perspective view of one preferred random signal generator that can be utilized in the game.

One of the more preferred types of random signal generator is illustrated in FIG. 6 wherein the random signal generator is comprised of a case 30 with coordinate strips 31 and 32. Coordinate strip selector 35 and 36 are coupled with a suitable lightbulb that can be moved about under the surface of case 30 such that one player can position coordinate strip 35 in a desired location while the other player positions coordinate strip 36 in a desired location and thereafter switch means 33 can be depressed to cause the lightbulb to be illuminated and thus shine through a suitable semi-opaque sheet 34 of material with numbers printed thereon thus illuminating the number appearing directly above the lightbulb. Semi-opaque sheet 34, with the series of numbers printed on one side thereof can be simply laid across the top surface of case 30 with the numbers printed thereon facing downwardly. Thus, it is impossible for the individual players to know exactly what numbers will be selected until coordinate strip selectors 35 and 36 have been properly positioned and the lightbulb is illuminated by means of switch means 33. Of course, suitable battery means (not shown) can be disposed within the case to supply the necessary electric power for the lightbulb. This type of apparatus is well-known in the art.

Figure 7:
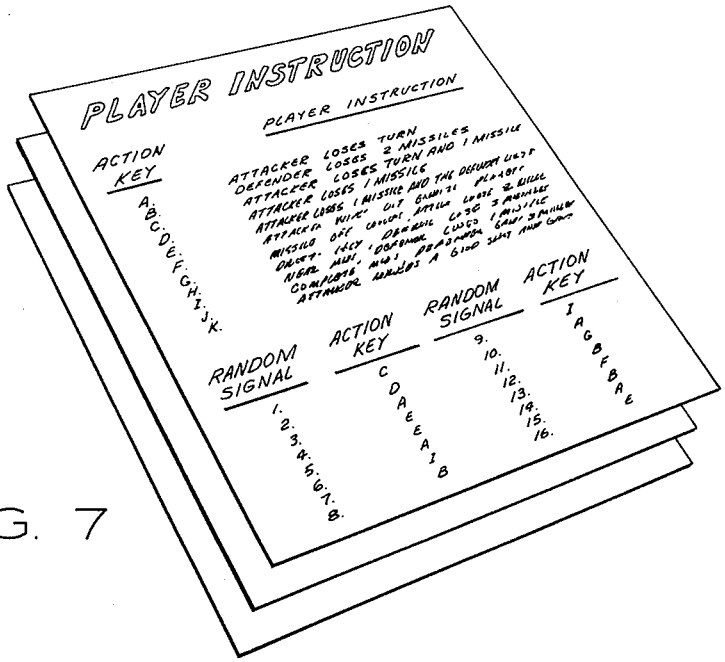
FIG. 7 is a perspective view of a preferred set of player instruction means.
Figure 8:
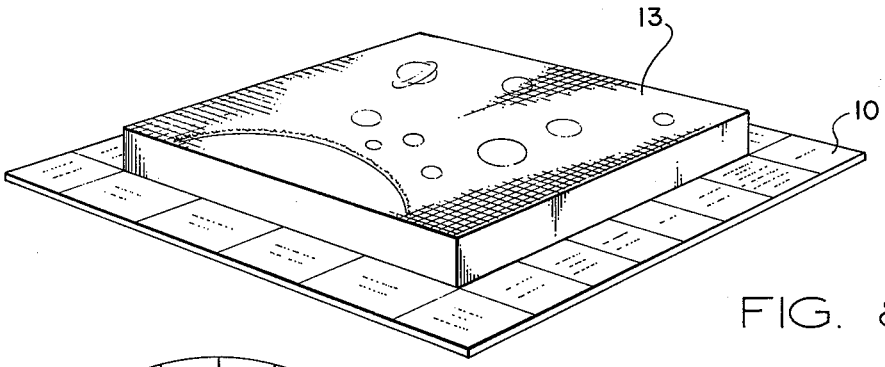
FIG. 8 is a perspective view of an inner playing board and an outer playing board with the surface of the inner playing board being substantially parallel to and above the plane of the outer game board.
Figure 9:
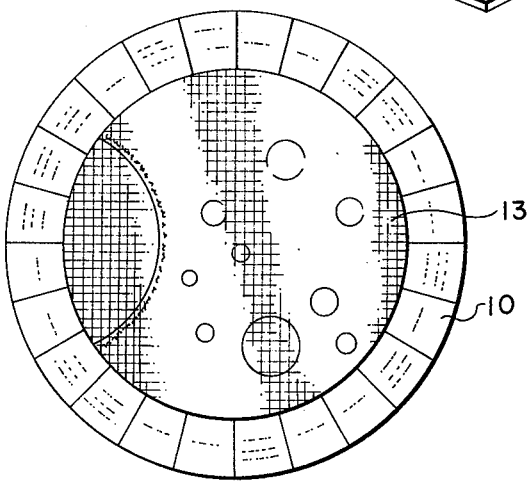
FIG. 9 is a top view of a circular outer playing board with a circular inner playing board disposed in concentric relationship to the outer game board.

It will be apparent that by changing the individual semi-opaque sheets 34, having random numbers disposed across the lower surface thereof, the actions of the individual players in positioning coordinate strip selectors 35 and 36 will lead to a completely random generation of the signals or numbers that can be thereafter utilized. Once the random signal is generated, illustrated in FIG. 6 as being numeral "51", a simple set of instruction means can be utilized to decode the action directed by signal "51". Such a table can be a numerical listing of numbers appearing on the underside of semi-opaque sheet 34 with suitable designations for the action to be taken. These sheets can be referred to as "battle sheets", "computer sheets", etc. The sheets serve as instruction means having indicia thereon to instruct the players to make movement and placement of the player token means 26 and/or 27 responsive to the random signal generated by the random signal generator means. It is preferred that a plurality of the foregoing instruction means be provided to be used in conjunction with the random signal generator so that it will be absolutely impossible for any one player to predetermine what action will be undertaken during the battle portion of the game. One preferred type of instruction means is illustrated in FIG. 7 whereon a table is printed and used to match the random signal generated by the random signal generator with an action key and the action keys show what action should be undertaken. The table appearing on the player instruction means of FIG. 7 can be of the same general type as set forth below. Using the example of a random signal "51", the table shows the action key for signal "51" is key H. The action corresponding to key H is "Direct hit, defender loses 3 missiles."

| Action Key | Player Instruction |
|---|---|
| A. | Attacker loses turn. |
| B. | Defender loses 2 missiles. |

-continued

C. Attacker loses turn and 1 missile.
D. Attacker loses 1 missile.
E. Attacker loses 1 missile and the defender loses 2 missiles.
F. Attacker wipes out entire planet.
G. Missile off course, attacker loses 3 missiles.
H. Direct hit, defender loses 3 missiles.
I. Near miss, defender loses 1 missile.
J. Complete miss, defender gains 3 missiles.
K. Attacker makes a good shot and gains 3 missiles.

| Random Signal | Action Key | Random Signal | Action Key |
|---|---|---|---|
| 1 | C | 9 | I |
| 2 | D | 10 | A |
| 3 | A | 11 | G |
| 4 | E | 12 | B |
| 5 | E | 13 | F |
| 6 | A | 14 | B |
| 7 | I | 15 | A |
| 8 | B | 16 | E |
| 17 | D | 41 | D |
| 18 | C | 42 | B |
| 19 | H | 43 | K |
| 20 | J | 44 | A |
| 21 | A | 45 | K |
| 22 | K | 46 | I |
| 23 | I | 47 | B |
| 24 | B | 48 | H |
| 25 | H | 49 | D |
| 26 | A | 50 | A |
| 27 | H | 51 | H |
| 28 | B | 52 | C |
| 29 | A | 53 | A |
| 30 | C | 54 | G |
| 31 | D | 55 | B |
| 32 | A | 56 | H |
| 33 | H | 57 | E |
| 34 | E | 58 | A |
| 35 | A | 59 | I |
| 36 | I | 60 | F |
| 37 | B | 61 | B |
| 38 | A | 62 | A |
| 39 | J | 63 | J |
| 40 | I | 64 | C |

The game is played by first arranging the inner and outer boards as shown in FIG. 1. At least two, but not more than six, may play the game. Each player then selects a player marker that will be utilized during the game. As previously mentioned, the most convenient way for designating the player markers is by suitable color code.

A "missile commander" is then selected by the players. The duties of the missile commander basically include the responsibility for giving out or taking away player tokens in accordance with the rules of the game and in accordance with the instructions found on the orbit cards and on the instruction means during the battle portion of the game. The object of the game is to capture planets, to acquire ships and missiles for the battle portion of the game and to destroy the opponents' territories and player tokens thereon until only one player still has player tokens remaining on the inner game board. The last player to have player tokens remaining on the inner game board is the winner.

Each of the players begins the game by placing one of the preselected player markers 25 on "start" position 12 on the periphery of the outer game board 10. The players then roll a die to determine who has the first move. The order of play proceeds in a counterclockwise direction.

To start the game, the players move their individual player markers the designated number of spaces corresponding to the roll of the die. A player is obligated to take the action designated by the instructional indicia found within the player position at the periphery of the outer game board as they land on each such position. For example, a player landing on the player position marked "orbit card" will draw the top card from the stack of previously shuffled orbit cards and will take the action indicated thereon. Some of the orbit cards may be designated as being allowed to be retained for future use by the drawing player, and such designation will appear on the face of the orbit card. A player landing on the player position indicated "free missile" will receive one player token from the missile commander. The player receiving the free missile will retain the free missile in front of him but will not place it on the game board until the final battle portion of the game is waged.

A player landing on the player position "launch pad" will immediately place one of his player markers 25 on the row in the sun 15 of inner game board 13 that is designated as his and will also take a new player marker 25 and place it on the "start" position 12. The first player to place a player marker or ship on the sun will occupy the row of grid segments designated as row 1. The second player placing a player marker 25 or a player token on the sun will occupy row 2, etc. Two player markers 25 are required to be on the sun before they can be exchanged for a player token 26 for movement within the grid squares on the surface of inner game board 13.

Once a player has a player token 26 on the sun 15 of inner game board 13, that player has an option of moving either token 26 on inner game board 13 or player marker 25 on outer game board 10 on each successive turn to roll the die.

A player marker landing on the playing position marked "extra turn and free missile" will receive a missile and an additional roll of the die for movement about the periphery of the outer game board. The player position marked "space station" is a neutral position in which no action is taken by the player landing on that space. The player position marked "mine" penalizes the player on the next round of play and the player loses his turn to roll the die in the next round of play.

Player positions marked "back to start" return the player marker to the start position for the next round of play. The player position marked "extra turn" entitles the player to an additional roll of the die and movement. The player position marked "free ship" entitles the player to the receipt of one player token in his designated row on the sun. This receipt of a free ship in no way affects any player markers that may already be present on the sun. The player position marked "lose one ship" requires the player to remove one player token 26 from the surface of inner game board 13. If the player landing on the position "lose one ship" does not have a player token on the surface of inner game board 13 no action is taken. The player position marked "move one opponent's ship between planets back to the sun" entitles the player to move any one player token 26 of any one opponent back to the designated row in the sun so long as player token 26 is not occupying one of the planets on the surface of inner game board 13.

It will be apparent that the object of the movement around the periphery of outer game board 10 is to move player markers from the periphery of the outer game board 10 to the designated row of grid squares on the sun which appears on the surface of inner game board 13. As soon as a player has at least one player token 26 on the sun 15, movement can be made using that player token across the surface of inner game board 13, within the designated grid segments. Movement across the surface of inner game board 13 is again dictated by a roll of the die, during the normal round of play. Movement in the grid segments on the surface of inner game board 13 may be in a vertical, horizontal or diagonal line. The object of moving game tokens 26 across the surface of inner game board 13 is to occupy and capture the individual planets designated on the surface of inner game board 13.

Capture of planets is accomplished by a player placing two player tokens 26 on a planet. Only those grid squares that are completely covered by the planet designation count as grid squares for capture of a planet. Therefore, a grid square that is partially within and partially without the outline of a planet does not count toward occupation of that planet for capture purposes. Movement of player tokens 26 across the surface of game board 13 is the exact number of spaces rolled on the die.

No two game tokens 26 may rest on the same grid square within the confines of inner game board 13 except in the occupation and control of a planet having only one grid square area. Thus, when one game token 26 comes to rest on the same grid square as that occupied by an opponent's player token 26, then the opponent's player token 26 is immediately returned to his designated row in the sun.

Once a player places two player tokens on a single planet, that player captures the planet and it becomes that player's property for the remainder of the game. Any other player having game tokens 26 resting on that planet must take the shortest way out of that planet on the succeeding rolls of the die.

Play proceeds until all of the planets have been captured by the individual players in the game. Once the planets have all been captured, the game proceeds into its final stage wherein a series of tactical maneuvers are undertaken by the individual players to destroy planets and game tokens owned by the opponents. At this stage in the game, each player will place the missiles, which are player tokens 27, on the planet or planets belonging to that player. Player tokens 26 are exchanged for the player tokens 27 that will be utilized in the final battle portion of the game.

Each player will be awarded an additional number of player tokens 27 for the battle portion of the game for each planet they own in accordance with the following totals: Mercury — 2 tokens, Venus — 3 tokens, Earth — 3 tokens, Mars — 4 tokens, Saturn — 2 tokens, Jupiter — 2 tokens, Neptune — 3 tokens, Uranus — 3 tokens, Pluto — 5 tokens.

Players may arrange the individual player tokens 27 in any group or groups on the planets owned by the individual player. Thus, a player owning several planets may place some or all of the player tokens 27 on any individual planet owned by that player.

Following the placement of player tokens 27 on the planets, the battle portion of the game is carried out utilizing the above-described random signal generator and the instruction means. If any player does not own any planet at the time all of the planets have been captured, then that player is immediately eliminated from the game. When the player tokens 27 have been arranged on the planets belonging to the individual players, the players roll the dice to determine what player will be the first attacker. The attacker then declares which planet belonging to any of his opponents he will attack first. After declaring which planet shall be attacked, the attacker and the defender then proceed to operate the random signal generator to produce the random signal which is thereafter decoded by the instruction means and the players carry out the action indicated by the instruction means. The attacker shall continue to attack until he loses his turn as a result of one of the commands by the instruction means or until that attacker no longer desires to continue the attack or until he loses all of his missiles. Play then proceeds to the next player on the right who shall carry out the attack. The game ends when only one player has a player token or tokens remaining on the surface of the inner game board.

It will of course be apparent to those skilled in the art that the foregoing preferred configuration of the inner and outer game boards may be altered if desired. For example, the inner and outer game boards may be arranged such that the inner board is not placed in the center of the outer game board. Additionally, both the inner and outer game boards may be printed on a common base or sheet, thus utilizing a common planar surface of play for both portions.

It will be apparent to those skilled in the art that many different modifications and changes may be made in the foregoing disclosure which represents only a few of the preferred embodiments of this invention. Thus, it will be appreciated that changes and modifications may be made in the foregoing disclosure without departing from the spirit and scope of the invention.

We claim:

1. A game apparatus comprising:

an outer game board having a plurality of means dividing the periphery thereof into a plurality of playing positions to accommodate player marker means;

indicia within each of said playing positions to convey instructions to players to take actions in accordance with preselected game rules;

an inner game board having at least three territorial indicia spaced apart and disposed on the surface of said inner game board and means dividing the surface of said inner game board into a grid comprised of a plurality of grid segments to accommodate player token means, said inner game board being adapted to be disposed within said outer game board with said plurality of playing positions of said outer game board extending around the outer edges of said inner game board;

at least two player marker means for movement around the periphery of said outer game board in accordance with preselected game rules, each of said player marker means being identifiable from the other of said player marker means;

a plurality of player token means for placement and movement within said grid segments of said inner game board in accordance with preselected game rules;

a plurality of instruction cards having indicia on one side thereof to instruct players to take certain actions in accordance with preselected game rules;

a chance means having a plurality of indicia thereon to determine movement of said player market means and said player token means;

a signal generator means to generate a random signal responsive to action by two separate players;

at least one instruction means having indicia thereon to instruct players to make movement and placement of said token means responsive to said random signal generated by said signal generator means.

2. The apparatus of claim 1 wherein said chance means comprises at least one die having said indicia imprinted on the faces thereof.

3. The apparatus of claim 2 wherein said signal generator means comprises a grid system having coordinate strips along both axes thereof and moveable coordinate selectors whereby each player selects one coordinate by moving one of said coordinate selectors, and means to generate a signal at the intersection of said coordinates.

4. The apparatus of claim 3 wherein said territorial indicia are in the form of representations of the sun and various planets.

5. The apparatus of claim 4 wherein said instruction means comprises indicia representing the random signals with corresponding key designators with indicia setting forth a tabulation of said key designators and the appropriate instructions to be followed by players corresponding to said key designators.

6. The apparatus of claim 4 wherein said outer game board is rectangular in shape and said inner game board is rectangular in shape and is disposed within the periphery of said outer game board.

7. The apparatus of claim 6 wherein said inner game board is disposed in a plane substantially parallel to and above the plane of said outer game board.

8. The apparatus of claim 4 wherein said outer game board is circular in shape and said inner game board is circular in shape and is disposed in concentric relationship to said outer game board.

9. The apparatus of claim 8 wherein said inner game board is disposed in a plane substantially parallel to and above the plane of said outer game board.

* * * * *